US007273215B1

(12) United States Patent
Smith

(10) Patent No.: US 7,273,215 B1
(45) Date of Patent: Sep. 25, 2007

(54) TOOL CREEPER

(76) Inventor: Kevin Smith, 1357 Mudlick Rd., Manchester, KY (US) 40962

( * ) Notice: Subject to any disclaimer, the term of this patent is extended or adjusted under 35 U.S.C. 154(b) by 9 days.

(21) Appl. No.: 11/391,179

(22) Filed: Mar. 29, 2006

(51) Int. Cl.
*B25H 1/12* (2006.01)

(52) U.S. Cl. ..... 280/32.6; 280/47.35; 280/79.2

(58) Field of Classification Search ..... 280/32.6, 280/32.5, 79.2, 79.11, 47.35, 47.34
See application file for complete search history.

(56) References Cited

U.S. PATENT DOCUMENTS

| | | | | |
|---|---|---|---|---|
| 1,104,398 | A | 7/1914 | Zimmerman | |
| 1,833,295 | A | 11/1931 | McCutchen | |
| 2,291,094 | A | 7/1942 | McCarthy | |
| 2,318,059 | A * | 5/1943 | Cooper | 280/32.5 |
| D152,008 | S | 12/1948 | Lucas | |
| 2,580,699 | A * | 1/1952 | Pfetzing | 362/138 |
| 2,636,705 | A * | 4/1953 | Stanton | 248/129 |
| 3,012,658 | A | 12/1961 | Flora | |
| 4,232,357 | A * | 11/1980 | Dietz | 362/486 |
| 4,698,731 | A * | 10/1987 | Johns, Sr. | 362/486 |
| 4,768,652 | A | 9/1988 | Fallon | |
| 4,795,180 | A | 1/1989 | Polcyn | |
| 4,986,558 | A * | 1/1991 | Morris | 280/32.6 |
| 5,219,446 | A | 6/1993 | Klepac | |
| 5,330,211 | A * | 7/1994 | Nicholson | 280/32.6 |
| 5,392,201 | A * | 2/1995 | Morley et al. | 362/486 |
| 5,494,305 | A * | 2/1996 | Chen | 280/32.6 |
| 5,685,421 | A | 11/1997 | Gilmore | |
| 5,897,122 | A * | 4/1999 | Borner | 280/32.6 |
| 6,238,069 | B1 | 5/2001 | Miles | |
| 6,305,049 | B1 | 10/2001 | Koch | |
| 6,428,181 | B1 | 8/2002 | Moriarty | |
| 7,198,511 | B2 * | 4/2007 | Brennan, Jr. | 439/501 |
| 2004/0100049 | A1 * | 5/2004 | Deasy et al. | 280/32.6 |

FOREIGN PATENT DOCUMENTS

| | | |
|---|---|---|
| GB | 2199544 | 7/1988 |

OTHER PUBLICATIONS www.orcon.com/FCISD/carpet catalog/dettoolbox wheels.htm Tool Box with Wheels.

* cited by examiner

*Primary Examiner*—Jeff Restifo
(74) *Attorney, Agent, or Firm*—Richard C. Litman

(57) ABSTRACT

The tool creeper is a rectangular box of a predetermined size related to work area requirements. The tool creeper has a plurality of compartments and drawers to accommodate tools. A plurality of creeper wheels having mounts are attached in a spatial relationship on the outside of a bottom panel to provide tool creeper movement that can readily follow a similar movement of the mechanic in a work space. Additionally, a proximal top surface has a pivotally attached lid for easy access and securement of the contents inside the tool creeper. On the rear of the tool creeper is a power cord socket to provide AC and DC power available for use in the work area. AC and DC power outlets are provided at a side panel of the tool creeper. A work area illumination light is provided along a rear top surface of the tool creeper.

19 Claims, 8 Drawing Sheets

TOOL CREEPER

BACKGROUND OF THE INVENTION

1. Field of the Invention

The present invention relates generally to tool creepers and more particularly to a tool creeper designed to assist a mechanic by providing a rolling toolbox beneath an automobile or some other upright inaccessible place.

2. Description of the Related Art

Creepers to assist a mechanic by providing a comfortable sliding surface beneath an automobile or some inaccessible place to an upright mechanic, are well known and used extensively. While mechanic's creepers improve the ergonomics between a mechanic and work piece by allowing movement of the mechanic there remains the issue of tool placement that is also ergonomically sound.

In the past, creepers have been modified in many ways to improve the convenience and ergonomics. Trays to hold tools have been added to mechanic's creepers. Yet the positioning of these attached trays often creates an ergonomic problem for the mechanic who wishes to access the tools without causing strain, muscle pain, and the like.

Additionally, a work area in which the mechanic may be working may lack sufficient lighting, causing eye strain in conjunction with the muscle pain and strain caused by attempting to access the required tools in a tool tray. Attempts made to rectify the aforementioned problems have still not been successful. Moreover, in the event that the mechanic should need DC or AC power for testing and/or tool use, a long extension cord with bulky powerstrip is usually required.

For example, U.K patent GB2199544, dated Jul. 13, 1988, discloses a box inside of a box. The inner box has compartments for tools. The outer box has wheels so that the entire unit may be rolled around. However, when in this configuration, the mechanic does not have access to the tools which are located in the inner box, thus defeating the advantage of tool mobility when underneath a vehicle, or the like.

None of the above inventions and patents, taken either singly or in combination, is seen to describe the instant invention as claimed. Thus, a tool creeper solving the aforementioned problems is desired.

SUMMARY OF THE INVENTION

The tool creeper is a rectangular box of a predetermined size related to work area requirements. The tool creeper has a plurality of compartments and drawers to accommodate tools. A plurality of creeper wheels having mounts are attached in a spatial relationship on the outside of a bottom panel to provide tool creeper movement that can readily follow a similar movement of the mechanic in a work space.

Additionally, a proximal top surface has a pivotally attached lid for easy access and securement of the contents inside the tool creeper. On the rear of the tool creeper is a power cord socket to provide AC and DC power available for use in the work area. AC and DC power outlets are provided at a side panel of the tool creeper. A work area illumination light is provided along a rear top surface of the tool creeper.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
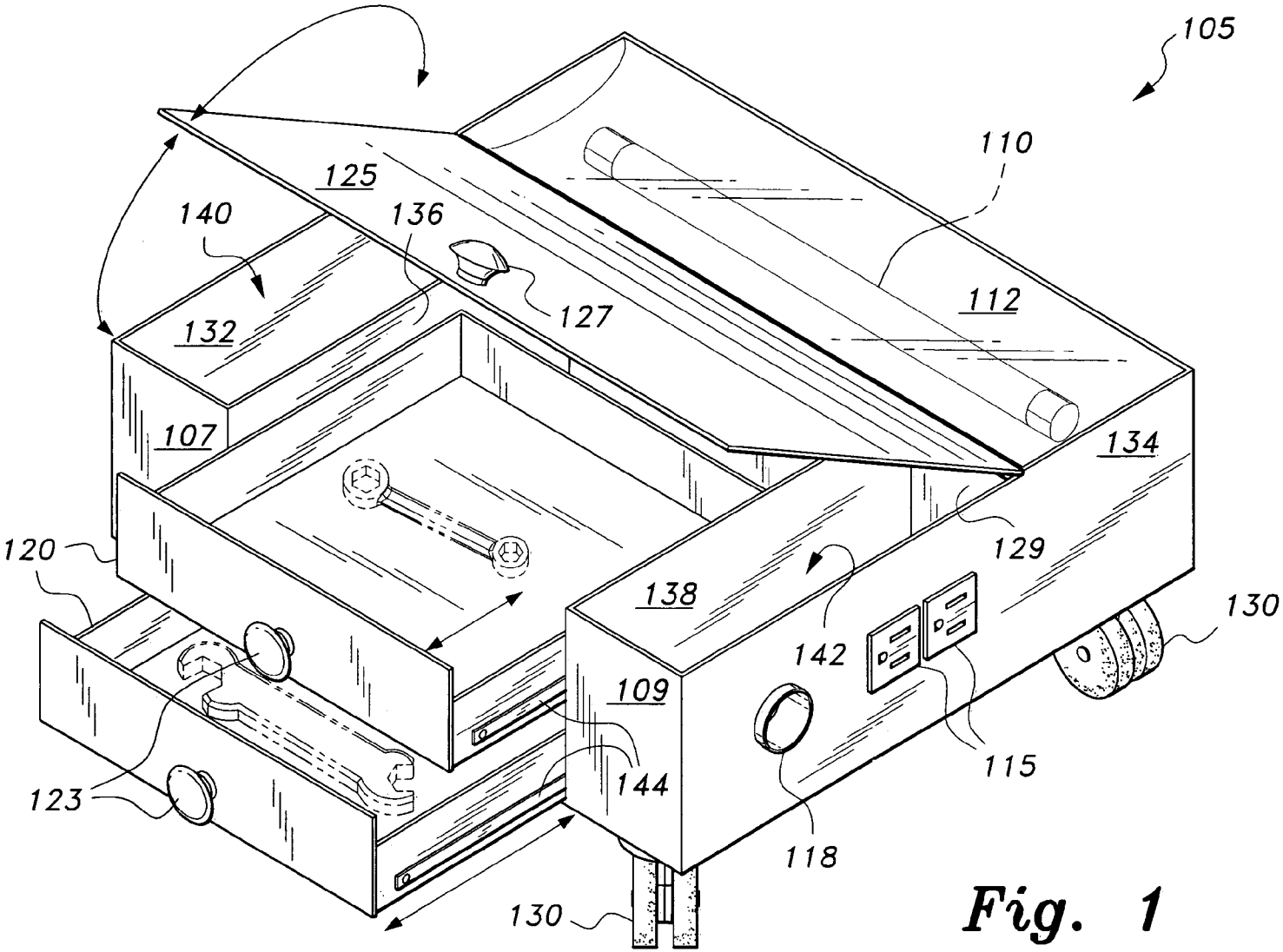
FIG. 1 is an environmental, perspective view of a tool creeper according to the present invention.

The present invention is, as shown in FIGS. 1-3 and 6, a rectangular box-like structure 105 of a predetermined size related to work area requirements. The tool creeper is formed from a bottom panel 305, a left side panel 132, a right side panel 134, a left front flap 107, a right front flap 109, a rear panel 430, a lid 125 forming a proximal top surface, and a visible light permeable cover 112 forming a distal top surface.

The tool creeper 105 has a plurality of compartments, such as left interior compartment 140, right interior compartment 142, and drawers 120 to accommodate tools. Sidewalls of left interior compartment 140 and right interior compartment 142 are formed from their respectively adjacent front flaps 107, 109, side panels 132, and 134. Rear side walls of the compartments 140, 142 are formed from a first vertical wall 129 disposed between the side panels 132 and 134 and extending between the bottom panel 305 and a partition formed between the proximal top surface and the distal top surface where the lid 125 and light cover 112 meet.

Second and third vertical walls 136 and 138 form inner sidewalls of the left compartment 140 and the right compartment 142, respectively. Optionally, compartments 140 and 142 may be further sub-divided to provide a plurality of part/tool separating bins. The drawers 120 are designed to fit in a rectangular open space defined by first vertical wall 129, second vertical wall 136, third vertical wall 138, and the front flaps 107, 109. The rails are slidably attached to the second and third vertical walls by a rail and track arrangement 144. Additionally, the lid 125 is preferably pivotally attached for easy access and securement of contents inside the tool creeper 105. As shown in FIG. 1, pivotal attachment of the lid 125 is provided by pivot hinge 210. Means, such as, for example, drawer knobs 123 and lid knob 127, are provided to allow a user to grasp the lid and drawers. Alternatively indentations, straps, and the like may be provided on the drawers 120 and lid 125 to allow the user to grasp them.

Figure 2:
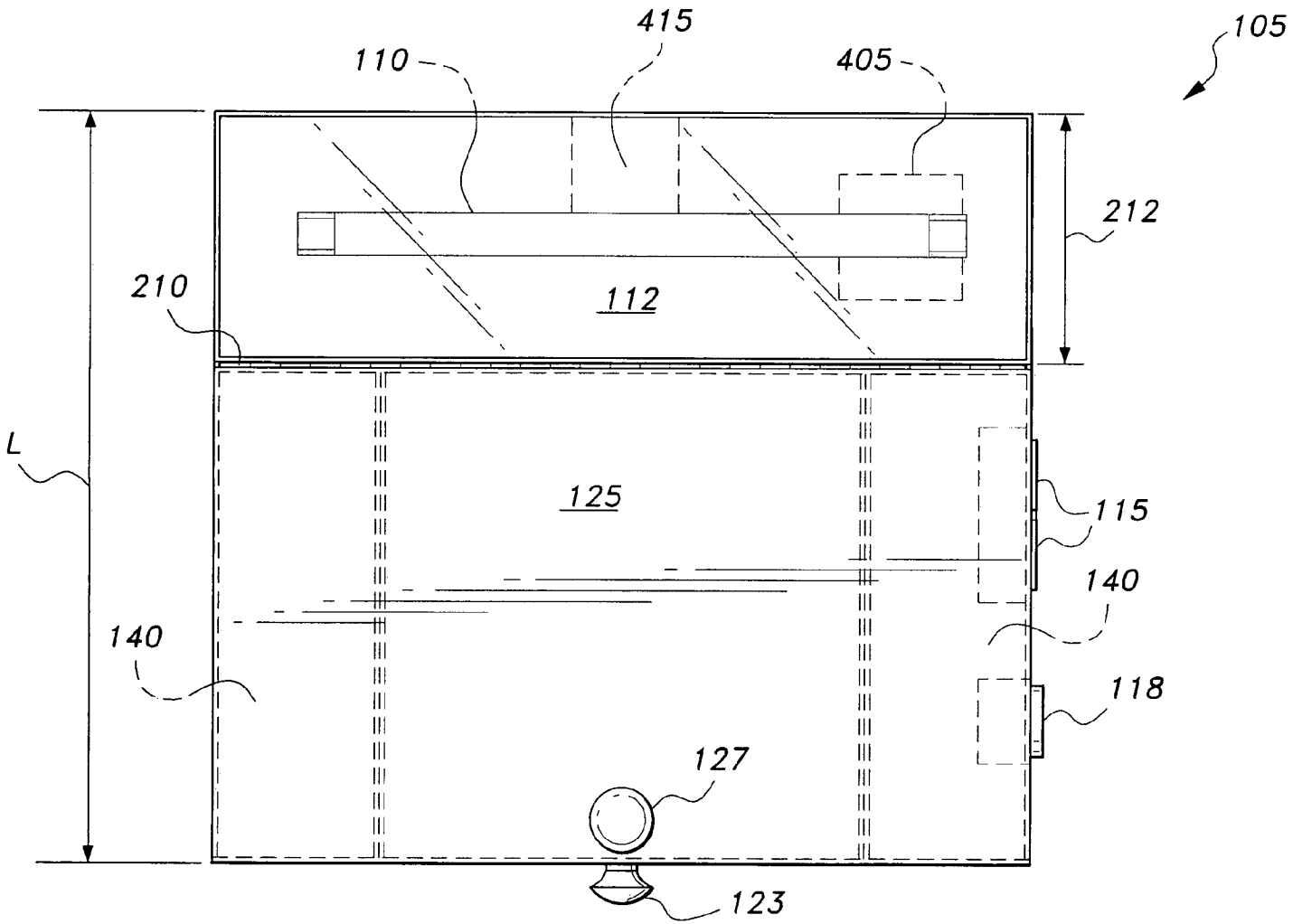
FIG. 2 is a top view of the tool creeper, according to the present invention.
Figure 3:
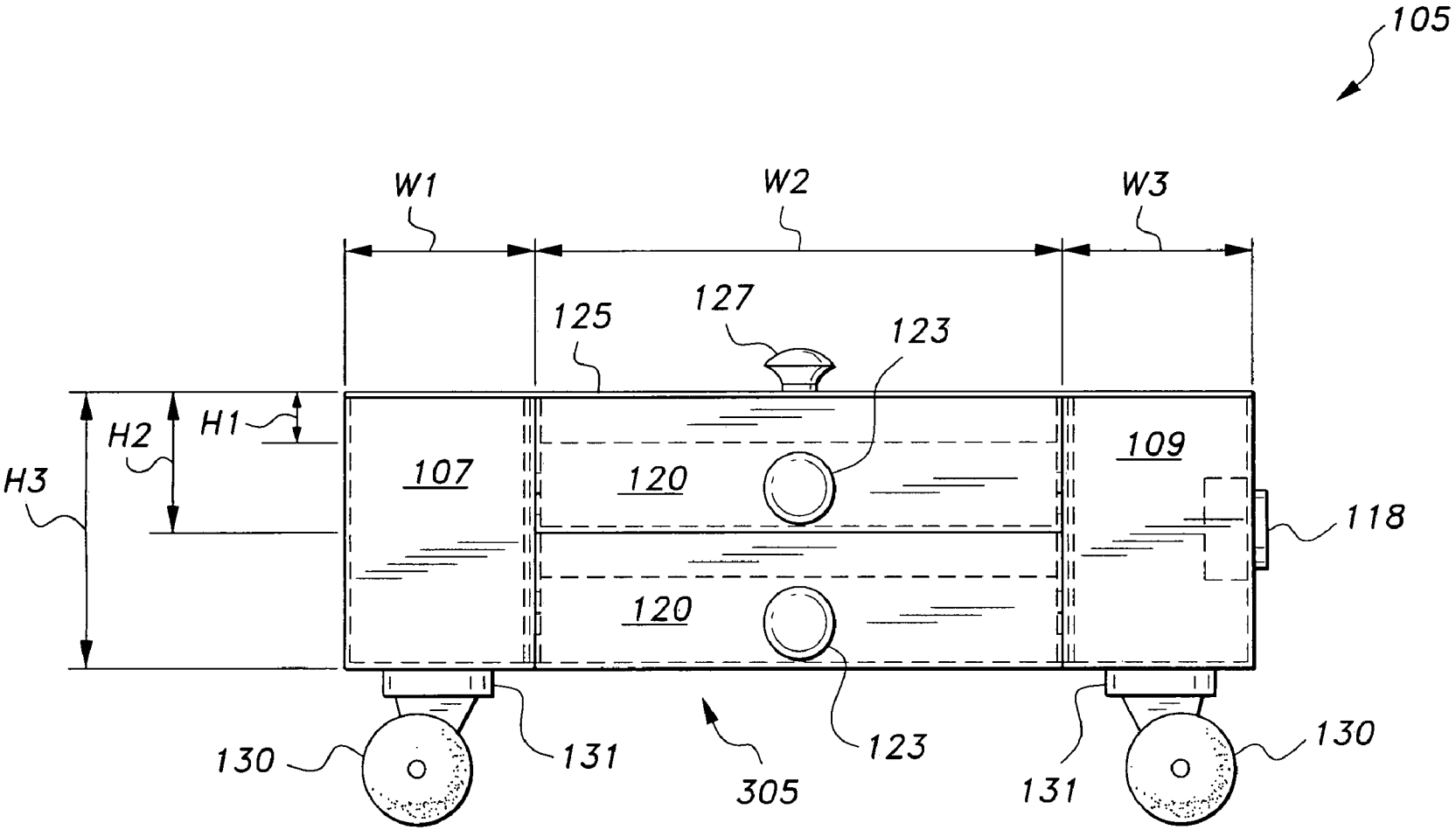
FIG. 3 is a front view of the tool creeper, according to the present invention.

As shown in FIG. 3, the structure of tool creeper 105 has an over all height H3. Front drawer panels are preferably equally sized and preferably each having a drawer panel height H2 so that combination height of upper and lower drawer panels is substantially equal to the over all structure height H3, leaving a small gap between the front panels of the two drawers 120, and a small gap between the bottom drawer panel and the bottom structure panel 305. In a preferred embodiment, the over all height H3 is approximately six inches. Moreover in the same preferred embodiment each drawer 120 has a depth H1 of two inches. A preferred overall width of the structure W1+W2+W3 is approximately twenty inches, where W1 and W3 are widths of left front flap 107 and right front flap 109, respectively, and W2 is width of drawer 120. Width W2 of drawer 120 is preferably twelve inches, while width W1 of left front flap 107 is preferably four inches, and width W3 of right front flap 109 is preferably four inches. As shown in FIG. 2, overall length L including rear section length 212 of the tool creeper 105 is approximately eighteen inches. Rear section length is preferably approximately six inches.

As shown in FIG. 3, a plurality of creeper wheels 130 having preferably swivel mounts 131 are attached in a spatial relationship on the outside of a bottom panel 305 to provide tool creeper movement that can readily follow a similar movement of the mechanic in a tight work space. According to the present invention, alternative low friction rolling structures such as bearings, casters, and the like may be provided in lieu of creeper wheels 130 and swivel mounts 131.

Figure 4A:
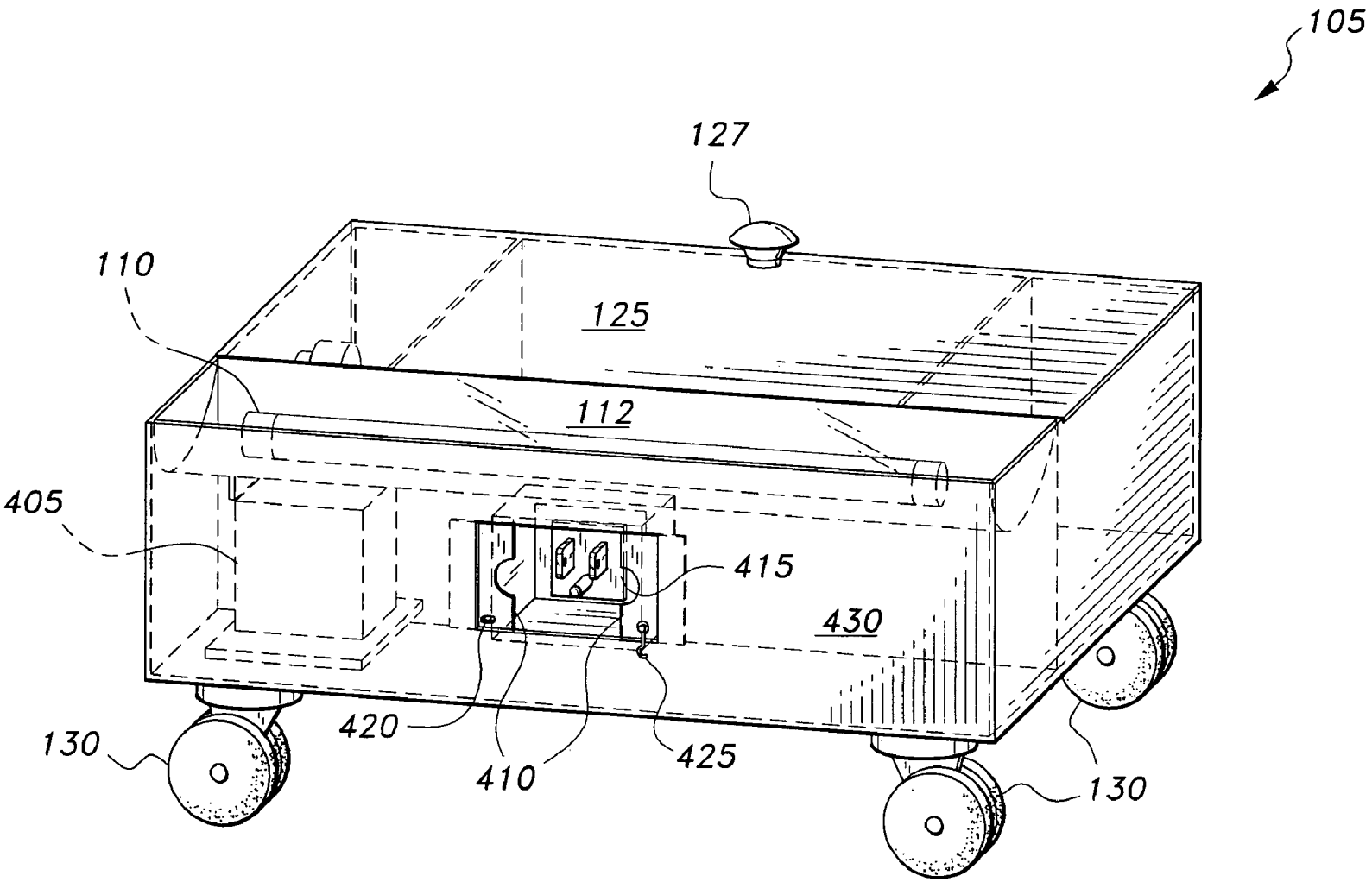
FIG. 4A is a rear perspective view of the tool creeper, according to the present invention.
Figure 7:
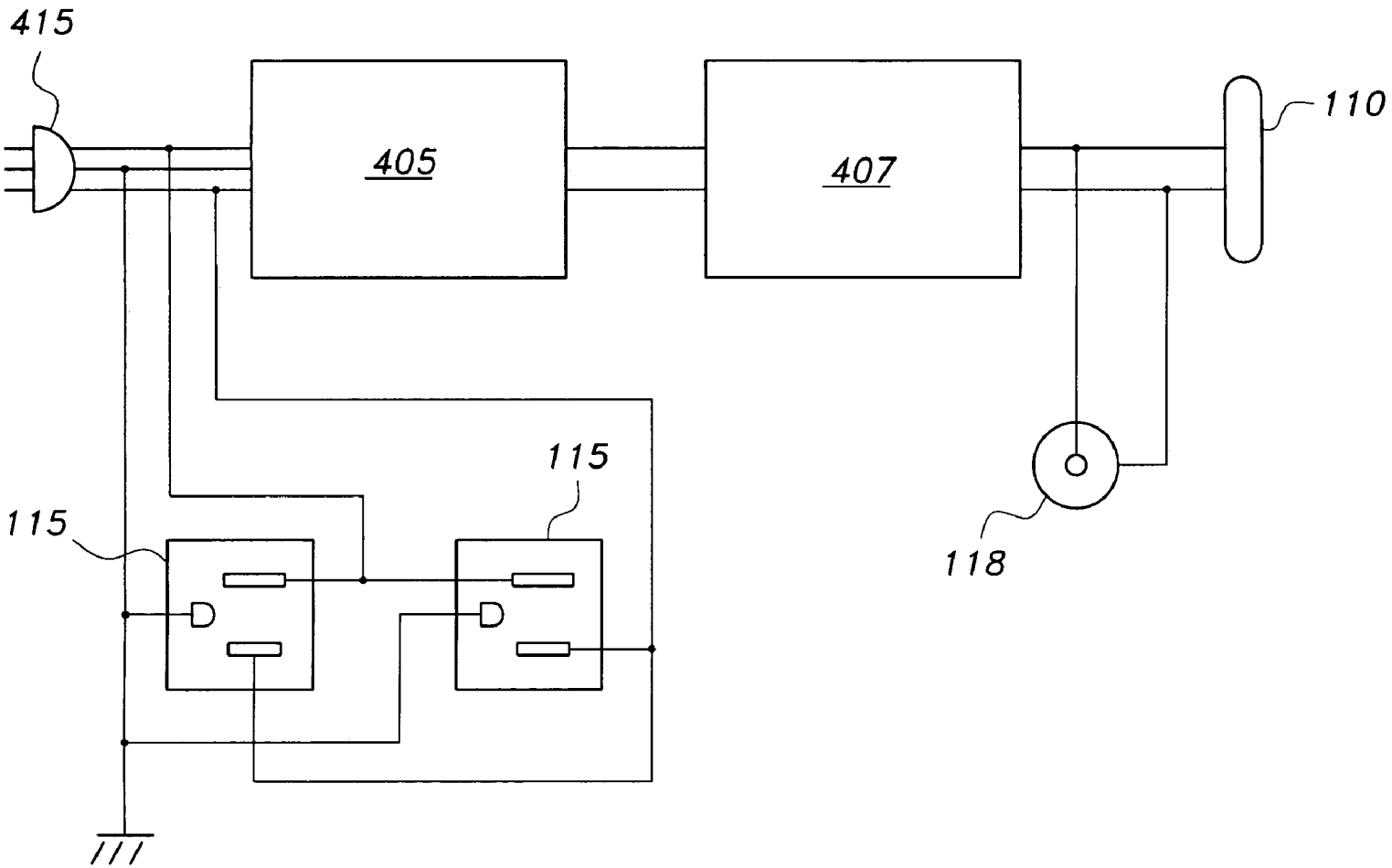
FIG. 7 is a schematic diagram of the tool creeper electrical system, according to the present invention.

As shown in FIGS. 4A and 7, to the rear, i.e., distal end, the tool creeper 105 has, behind a cutout in the rear panel 430, a recessed area containing a power plug 415 which is electrically configured to provide AC and DC power for use in the work area when the plug 415 is connected to the mains by an extension power cord. A transformer 405 is attached inside the tool creeper 105 proximate to the power plug 415. As shown in FIG. 7, preferably, a rectifier 407 is provided to convert output of the transformer 405 to direct current DC.

Figure 4B:
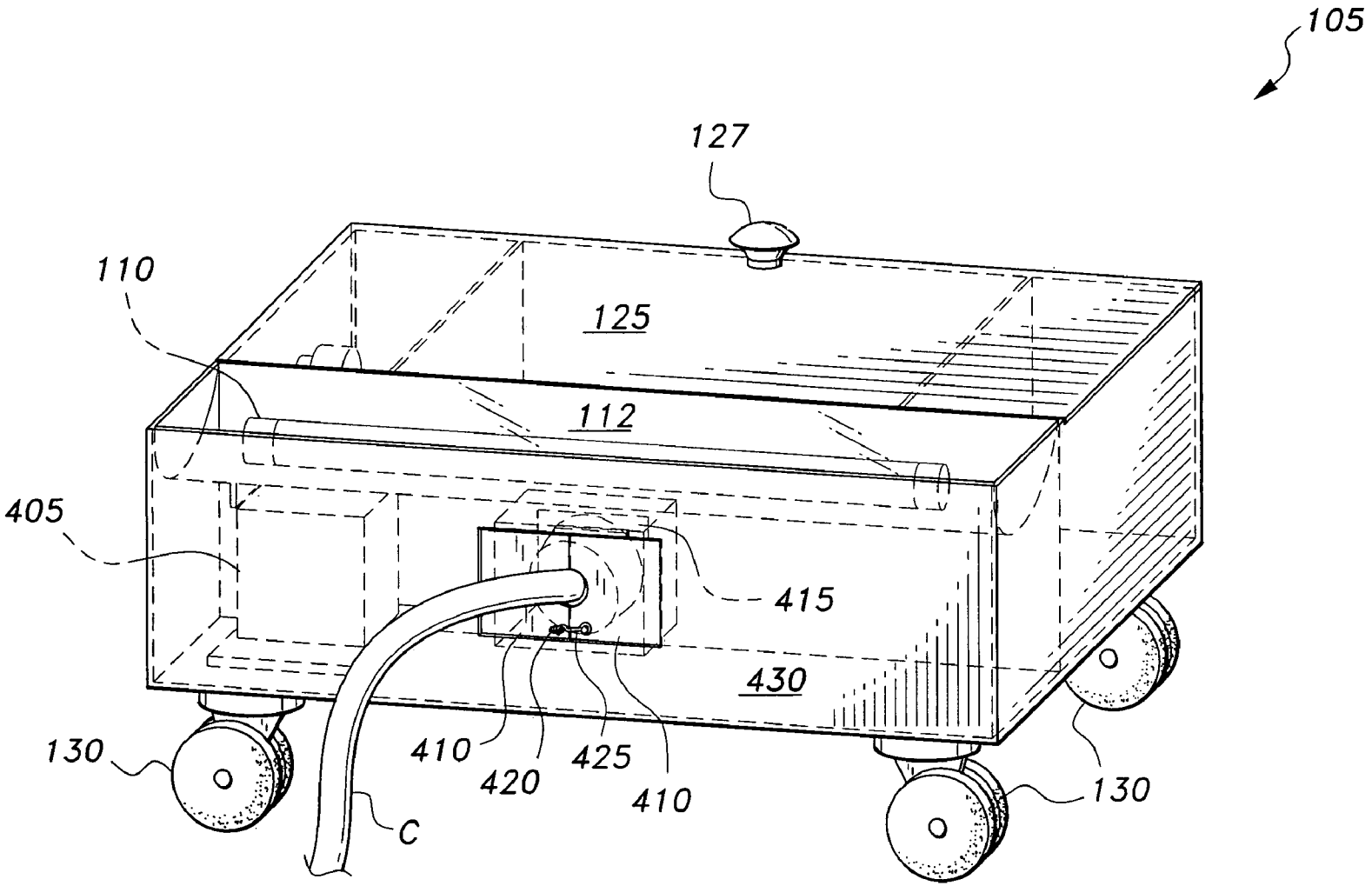
FIG. 4B is a rear perspective view of the tool creeper with removably attached power cord, according to the present invention.

Referring to FIGS. 4A-4B, sliding power cord access doors 410 are provided in the rear panel 430 to secure a power cord C in place when connected to the power plug 415. Each access door 410 has a semi-circular indentation on its leading edge, so that the doors fully encircle and grasp a power cord connected to power plug 415 when the doors are closed. Preferably the circular diameter created by closed access doors 410 is approximately 10 mm, slightly larger than the diameter of a typical extension power cord. Fastening means such as hook 425 and hoop, i.e., loop 420 are provided to securely close the doors 410 on the connected power cord C.

Figure 5:
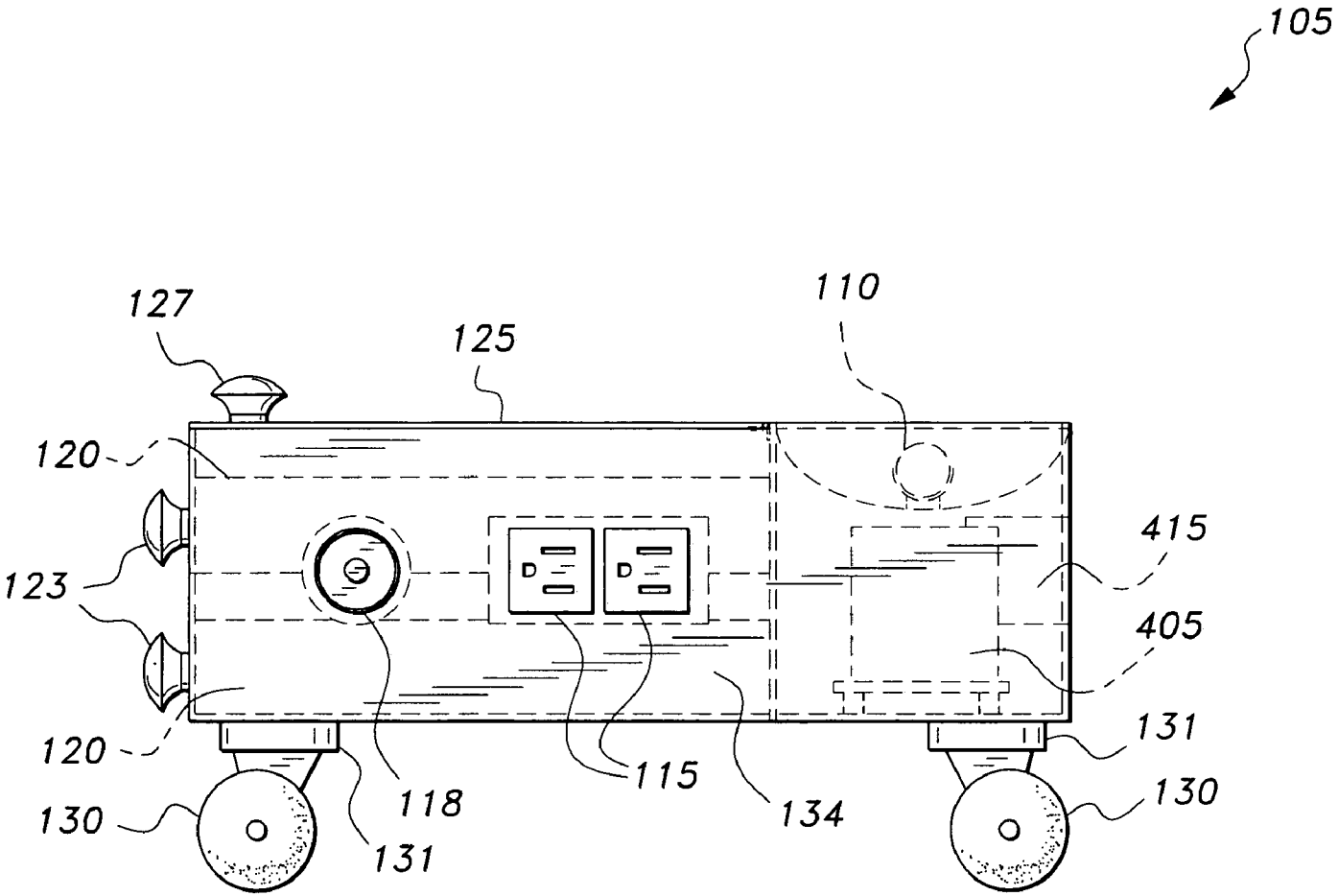
FIG. 5 is a right side view of the tool creeper, according to the present invention.
Figure 6:
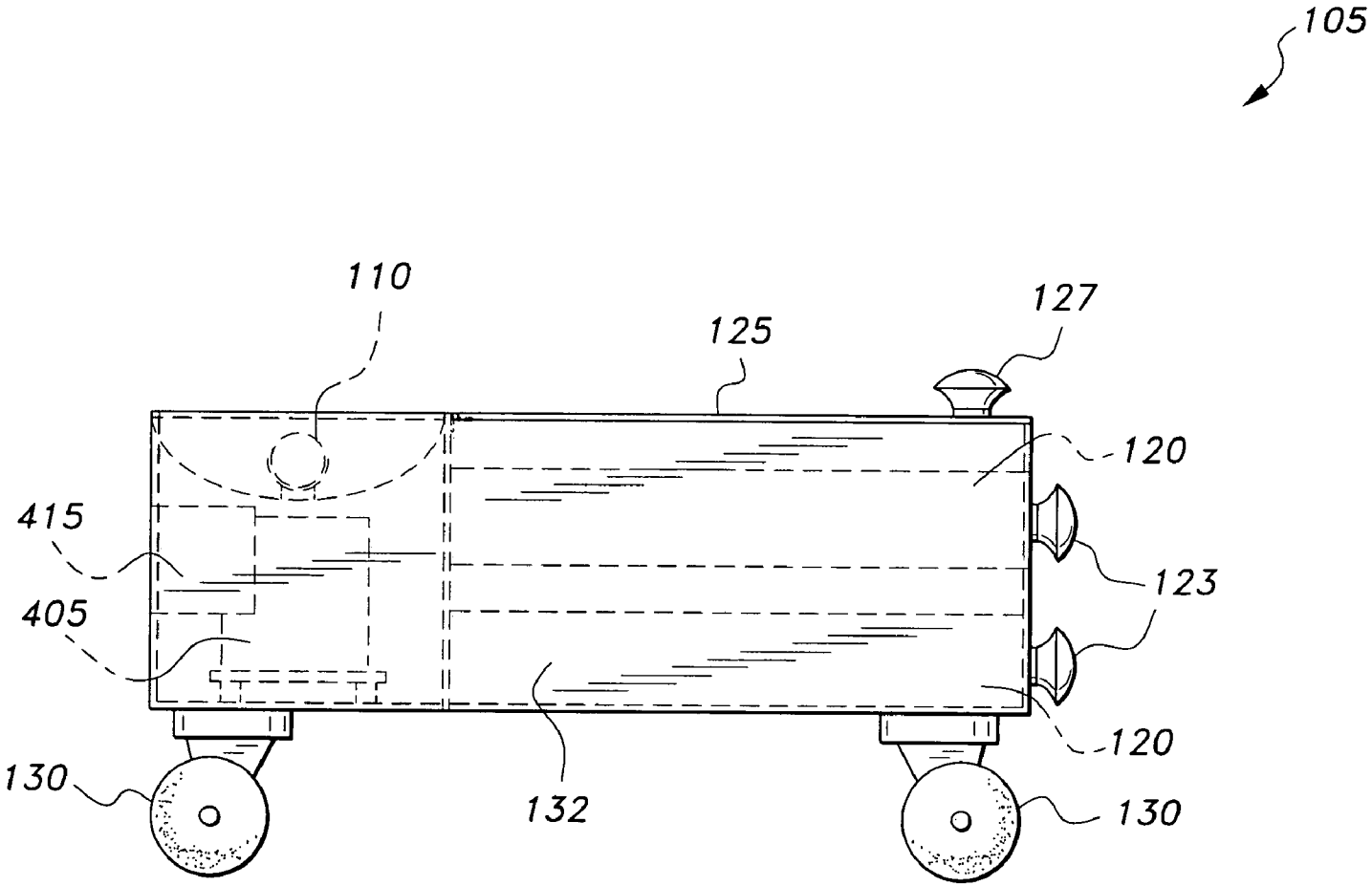
FIG. 6 is a left side view of the tool creeper, according to the present invention.

As shown in FIGS. 1 and 5, AC power outlets 115 and at least one preferably DC power outlet 118 are provided through cutouts on a side panel such as side panel 134 of the tool creeper 105. Preferable voltage output from power outlets 115 is between 110V and 120V AC. Preferable voltage output from power outlet 118 is approximately 12V. A work area illumination light 110 is provided beneath the visible light permeable rear, i.e., distal, top surface 112 of the tool creeper 105.

Preferably a DC output of the rectifier 407 provides power to the work area illumination light 110 and the DC power outlet 118. Alternatively an alternating current tap may be provided to power up the work area illumination light 110.

It is to be understood that the present invention is not limited to the embodiment described above, but encompasses any and all embodiments within the scope of the following claims.

I claim:

1. A tool creeper, comprising:

a rectangular box-like structure having a bottom panel, a left side panel, a right side panel, a left front flap, a right front flap, a rear panel, a distal top surface, and a proximal top surface;

the distal top surface comprises a visible light permeable cover;

the visible light permeable cover being disposed across an entire width of the structure;

the proximal top surface comprises a pivotally attached lid;

the pivotally attached lid being disposed across the entire width of the structure, and extending from the front of the structure to the visible light permeable cover, thereby forming the top partition;

a first vertical wall disposed between the side panels and extending between the bottom panel and a partition at the top surface;

the first vertical wall forming a left compartment rear sidewall and a right compartment rear sidewall;

the left side panel forming a left compartment outer sidewall;

the right side panel forming a right compartment outer sidewall;

second and third vertical walls forming respectively left and right compartment inner sidewalls, wherein the structure has a left side inner compartment and a right side inner compartment, the inner compartments extending from the front flaps to the first vertical wall;

a plurality of drawers slidably disposed within a space defined by the first, second and third vertical walls and the front flaps;

means allowing a user to grasp the lid and drawers;

an electrical light source disposed underneath the visible light permeable cover;

a plurality of AC and DC outlets disposed in at least one of the side panels;

AC and DC power generation means disposed within the structure to provide power to the electrical light source and the plurality of AC and DC outlets; and, rolling means spatially positioned on the outside of the bottom panel.

2. The tool creeper according to claim 1, wherein means allowing a user to grasp the lid and drawers comprises knobs attached to the drawers and the lid.

3. The tool creeper according to claim 1, wherein means allowing a user to grasp the lid and drawers comprises indentation finger holds disposed in the drawers and the lid.

4. The tool creeper according to claim 1, wherein the electrical light source is powered by approximately 110V AC.

5. The tool creeper according to claim 1, wherein the electrical light source is powered by approximately 12V.

6. The tool creeper according to claim 1, wherein the electrical light source is a lamp.

7. The tool creeper according to claim 1, wherein the plurality of AC and DC outlets comprises two AC outlets and one DC outlet.

8. The tool creeper according to claim 1, wherein the AC power generation means comprises a plug for accepting a power cord from a household AC source.

9. The tool creeper according to claim 8, wherein the plug is disposed behind a cutout in the rear panel of the tool creeper.

10. The tool creeper according to claim 9, wherein sliding power cord access doors, each having a semi-circular indentation on a leading edge are disposed in the rear panel to secure a power cord in place when the power cord is connected to the power plug.

11. The tool creeper according to claim 10, wherein the sliding power cord access doors have fastening means to lock the access doors in place around a connected power cord.

12. The tool creeper according to claim 11, wherein the fastening means comprise a hook on one of the doors and a loop on the other door.

13. The tool creeper according to claim 1, wherein the DC power generation means comprises a step-down transformer and a rectifier.

14. The tool creeper according to claim 1, wherein the rolling means comprises a plurality of wheels having swivel mounts attached to the bottom panel.

15. The tool creeper according to claim 1, wherein an over all height of the structure is approximately six inches.

16. The tool creeper according to claim 1, wherein an over all width of the structure is approximately twenty inches.

17. The tool creeper according to claim 1, wherein the rear section length is approximately six inches.

18. The tool creeper according to claim 1, wherein an over all length of the structure is approximately eighteen inches.

19. The tool creeper according to claim 1, wherein the slidably disposed drawers are slidably attached to the second and third vertical walls by a rail and track arrangement.

* * * * *